US007274333B1

(12) United States Patent
Alexeff

(10) Patent No.: US 7,274,333 B1
(45) Date of Patent: Sep. 25, 2007

(54) PULSED PLASMA ELEMENT

(76) Inventor: Igor Alexeff, 2790 Oak Ridge Turnpike, Oak Ridge, TN (US) 37830

( * ) Notice: Subject to any disclaimer, the term of this patent is extended or adjusted under 35 U.S.C. 154(b) by 54 days.

(21) Appl. No.: 11/003,949

(22) Filed: Dec. 3, 2004

(51) Int. Cl.
*H01Q 1/26* (2006.01)

(52) U.S. Cl. ..... 343/701

(58) Field of Classification Search ..... 343/701
See application file for complete search history.

(56) References Cited

U.S. PATENT DOCUMENTS

| | | | | |
|---|---|---|---|---|
| 5,594,456 | A * | 1/1997 | Norris et al. | 343/701 |
| 5,963,169 | A | 10/1999 | Anderson et al. | 343/701 |
| 6,211,617 | B1 | 4/2001 | Deegan | 315/39 |
| 6,369,763 | B1 | 4/2002 | Norris et al. | 343/701 |
| 6,492,951 | B1 | 12/2002 | Harris et al. | 343/701 |
| 6,674,970 | B1 | 1/2004 | Anderson | 398/121 |
| 6,710,746 | B1 | 3/2004 | Anderson et al. | 343/701 |
| 6,713,958 | B2 * | 3/2004 | Oniki | 313/582 |
| 6,922,173 | B2 * | 7/2005 | Anderson | 343/701 |
| 2002/0189763 | A1 | 12/2002 | Kwon et al. | 156/345.48 |
| 2003/0142021 | A1 | 7/2003 | Anderson | 343/701 |
| 2004/0061650 | A1 | 4/2004 | Anderson et al. | 343/701 |
| 2004/0130497 | A1 | 7/2004 | Alexeff et al. | 343/725 |

* cited by examiner

*Primary Examiner*—Michael C. Wimer
(74) *Attorney, Agent, or Firm*—Luedeka, Neely & Graham, P.C.

(57) ABSTRACT

A method of operating a plasma antenna, reflector, director, and barrier, where the plasma antenna is pulsed at a pulse power for a pulse duration and a pulse frequency to energize a plasma within the plasma antenna for an afterglow duration, where the pulse duration is shorter than the afterglow duration. In this manner, the power required to operate the plasma antenna is dramatically reduced, while the power at which the antenna operates can be dramatically increased. In addition, the antenna operates primarily in the low noise afterglow phase. Thus, several problems in regard to the prior art are overcome.

17 Claims, 1 Drawing Sheet

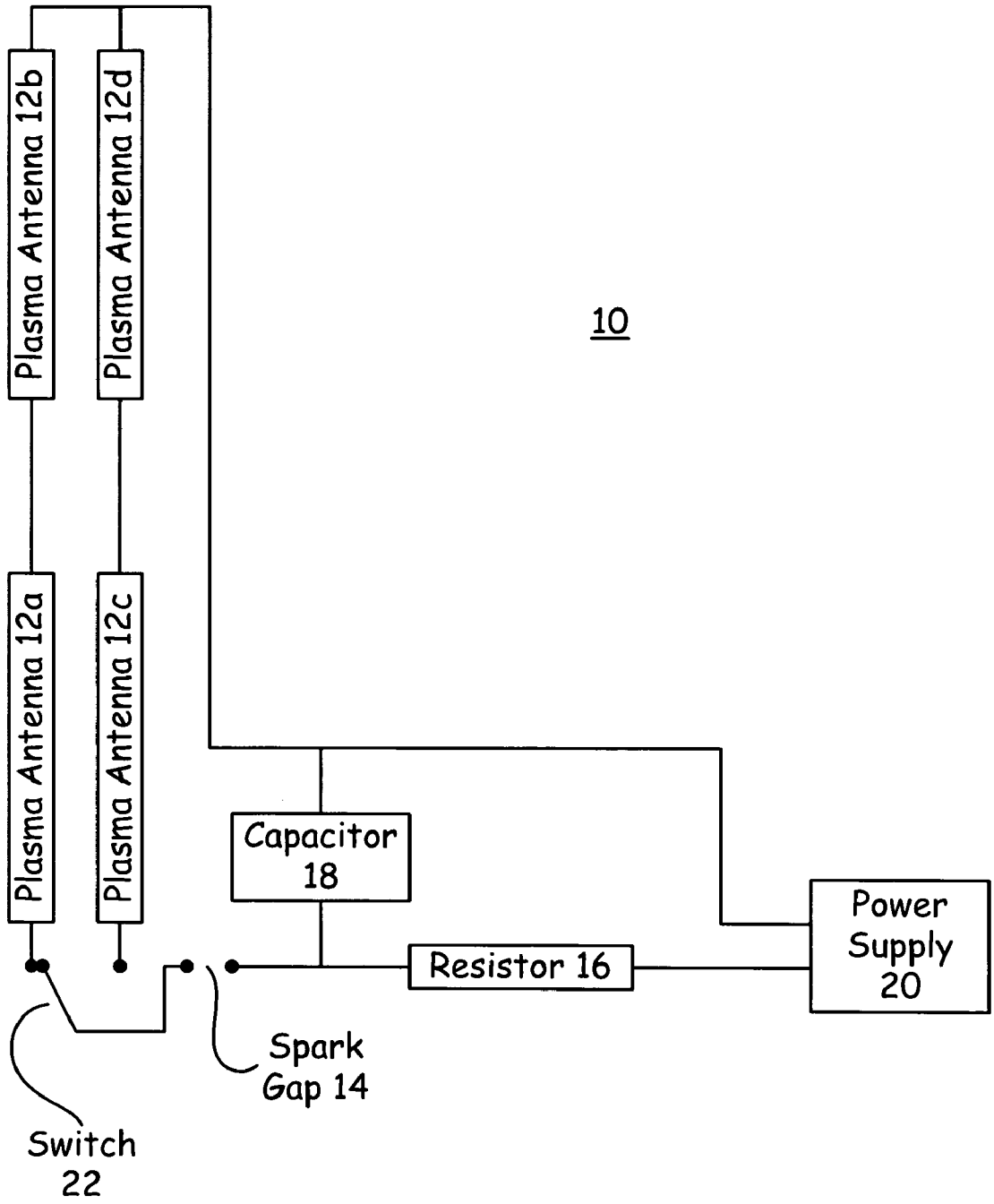
Plasma Antenna 12b
Plasma Antenna 12d
10
Plasma Antenna 12a
Plasma Antenna 12c
Capacitor 18
Power Supply 20
Resistor 16
Spark Gap 14
Switch 22

PULSED PLASMA ELEMENT

FIELD

This invention relates to the field of plasma generation. More particularly, this invention relates to plasma generation for use as an antenna, reflector, director, and barrier.

BACKGROUND

A plasma antenna can be as simple as a glass tube containing a rarefied gas, such as argon. A simple fluorescent lamp or a neon sign can act as a plasma antenna under the proper conditions. Under non energized conditions, the tube does not appreciably interact with radio waves. However, when the rarefied gas is ionized to contain free electrons, it electrically behaves as a metal. It can transmit, receive, and reflect radio waves. When the gas de-ionizes, it reverts to the non interacting state.

The advantages of plasma antennas over metal antennas are several. The plasma antenna can be made to disappear electrically when the gas is not ionized. In this state it does not appreciably reflect radio waves, and so is very useful for stealth applications. The plasma antenna is reconfigurable. Several plasma antennas can be placed in the same space, and only the ionized one will be effective, transmitting through the non ionized plasma antennas. The plasma antenna can be operational at a lower frequency, while being transparent at a higher frequency. This is useful in electronic warfare, when a high frequency electronic warfare signal will pass through an plasma antenna that is operating at a lower frequency, without interacting with it.

The plasma antenna operates as efficiently as a metal antenna in both reception and low power transmission. Although the plasma antenna has several advantages over a metal antenna, it also has several problems. The highest frequency that has been used for direct current transmission is eight hundred megahertz. When the discharge current is increased to increase the electron density and the plasma frequency (electron density dependent), the electrodes burn out. Further, during the duration of the current flow, plasma instabilities occur, and generate unwanted noise. In addition, the discharge current requires about twenty watts for a relatively small antenna, and for a multi tube antenna, the power consumption is quite high.

What is needed, therefore, is a plasma antenna that overcomes problems such as those described above, at least in part.

SUMMARY

The above and other needs are met by a method of operating a plasma antenna, where the plasma antenna is pulsed at a pulse power for a pulse duration and a pulse frequency to energize a plasma within the plasma antenna for an afterglow duration, where the pulse duration is shorter than the afterglow duration.

In this manner, the power required to operate the plasma antenna is dramatically reduced, while the frequency at which the antenna operates can be dramatically increased. In addition, the antenna operates primarily in the low noise, non-current carrying, afterglow phase. Thus, several problems in regard to the prior art are overcome.

In various embodiments according to this aspect of the invention, the pulse frequency is about one kilohertz and the pulse duration is between about two microseconds and about twenty microseconds. The afterglow duration is preferably longer than the pulse frequency. In various embodiments, the plasma antenna is a plurality of plasma antennae, that may be connected in series, in parallel, or in an array involving plasma antennae, directors, reflectors, and barriers. Preferably the plasma antenna is a plurality of selectively switchable plasma antennae. The plasma is preferably of a Ramsauer gas, and most preferably includes at least one of argon, krypton, and xenon gas.

According to another aspect of the invention there is described a method of operating a plasma antenna that includes a plurality of selectively switchable plasma antennae. The plasma antenna is pulsed at a pulse power for a pulse duration of between about two microseconds and about twenty microseconds and a pulse frequency of about one kilohertz to energize a plasma preferably of a Ramsauer gas within the plasma antenna for an afterglow duration, where the pulse duration is shorter than the afterglow duration.

According to yet another embodiment there is described an improvement to a plasma antenna. A pulser pulses the plasma antenna at a pulse power for a pulse duration and a pulse frequency to energize a plasma within the plasma antenna for an afterglow duration, where the pulse duration is shorter than the afterglow duration. In various embodiments according to this aspect of the invention, the pulse duration is about one microsecond and the pulse frequency is about one kilohertz. Preferably, the afterglow duration is longer than the pulse frequency.

BRIEF DESCRIPTION OF THE DRAWINGS

Further advantages of the invention are apparent by reference to the detailed description when considered in conjunction with the FIGURE, which is not to scale so as to more clearly show the details, wherein like reference numbers indicate like elements, and which depicts a functional block diagram of a plasma antenna according to a preferred embodiment of the present invention.

DETAILED DESCRIPTION

With reference now to the FIGURE, there is depicted a plasma antenna system 10 according to a preferred embodiment of the present invention. It is appreciated that the apparatus 10 as depicted in the FIGURE representation of many different physical embodiments that can be used to accomplish the methods of plasma antenna operation as described herein.

The system 10 preferably includes one or more plasma elements, including antennae, reflectors, directors, and barriers 12, which may be connected in series or in parallel, or in a configurable array of both. Switches such as switch 22 are preferably used to selectively activate desired ones of the plasma antennae 12. The antennae 12 are preferably glass structures of about an inch and a half in diameter. However, various lengths and diameters can be used as directed by the application for the antenna 12. If plasma noise is to be kept at a minimum, Ramsauer gases, such as argon, krypton, and xenon are preferably used in the antennae 12. These gases have a very low electron scattering cross section at low electron energies, in contrast to gases such as mercury vapor, which have a large cross section at low electron energies.

A simple spark gap oscillator is depicted in the FIGURE, which is used to pulse the current delivered to the antennae 12. Direct current from a power supply 20, such as a thirty kilovolt, ten milliamp, high voltage power supply, is preferably fed through a resistor 16, such as a 1.5 megaohm resistor, into a capacitor 18, such as a one nanofarad high voltage capacitor. In this manner, the voltage preferably rises with a time constant of about one millisecond. When the voltage reaches the desired peak of several kilovolts, a passive spark gap 14 sparks over and feeds the power to the antennae 12. The discharge preferably terminates in from about two to about twenty microseconds.

This spark gap pulser as described above is very noisy electrically, but other pulsers with less inherent noise are also contemplated hereunder. The specific pulser described herein is thus by way of example only, and not limitation. Under such conditions, the plasma preferably persists for well over one millisecond, such as for about ten milliseconds, so if the pulsing rate is on the order of one kilohertz, the plasma is essentially operating in the steady state, in what is called the afterglow regime, where the plasma noise is low.

The plasma is preferably pulsed repetitively in a time that is short when compared with the afterglow lifetime. One can either choose to not observe with the plasma antenna 12 during the pulse time, or observe during the pulse time, preferably using noise reduction methods.

There are several advantages of this method of operation. For example, the plasma density is generally much higher than that generated by a steady state energized discharge. Formerly, only a frequency of about eight hundred megahertz could be attained without burning out the plasma tube cathodes. However, a plasma antenna 12 operated according to the methods described herein can function at frequencies up to about 2.8 gigahertz in the steady state, which corresponds to an increase in the operating plasma density of about a factor of ten.

In addition, the power consumption in this mode of operation is lower than in a steady state energized operation. Using six plasma tubes connected in series for example, the average current consumed is only eight milliamps at about two hundred volts per tube, representing a total power consumption of about ten watts. Since each tube is rated at about sixteen watts, the total steady state power input would have been about one hundred watts. Thus, the plasma density in the present mode of operation is increased while at the same time the average operating power is decreased.

Further, the plasma tubes are in a low noise operating state—the afterglow—for most of the operating cycle. Since the current pulse preferably occurs over about two microseconds and the afterglow regime preferably occurs over about one millisecond, the current carrying state lasts for only about two tenths of a percent of the operating cycle.

Because the afterglow of the pulsed plasma antenna 12 exists for several milliseconds after the pulse as described above, the individual plasma tubes 12 may be pulsed sequentially rather than simultaneously. This allows considerable simplification in the drivers for the pulsing circuits, such as reducing the number of switches required for an array of antennae 12. For large arrays, the cost saving can be considerable. Exciting the discharges by pulses of current that alternate in polarity during the pulse tends to reduce noise generation.

The foregoing description of preferred embodiments for this invention has been presented for purposes of illustration and description. It is not intended to be exhaustive or to limit the invention to the precise form disclosed. Obvious modifications or variations are possible in light of the above teachings. The embodiments are chosen and described in an effort to provide the best illustrations of the principles of the invention and its practical application, and to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally, and equitably entitled.

What is claimed is:

1. In a method of operating a plasma element, the improvement comprising pulsing the plasma element at a pulse power for a pulse duration and a pulse frequency at a pulse polarity to energize a plasma within the plasma element for an afterglow duration, where the pulse duration is shorter than the afterglow duration and the afterglow duration is no less than a reciprocal of the pulse frequency, wherein the plasma is of a Ramsauer gas.

2. The method of claim 1, wherein the pulse frequency is about one kilohertz.

3. The method of claim 1, wherein the pulse polarity alternates during the pulsing.

4. The method of claim 1, wherein the pulse duration is between about two microseconds and about twenty microseconds.

5. The method of claim 1, wherein the pulse duration is between about two microseconds and about twenty microseconds and the pulse frequency is about one kilohertz.

6. The method of claim 1, wherein the plasma element further comprises a plurality of plasma elements.

7. The method of claim 1, wherein the plasma element further comprises a plurality of plasma elements connected in series.

8. The method of claim 1, wherein the plasma element further comprises a plurality of plasma elements connected in parallel.

9. The method of claim 1, wherein the plasma element further comprises a plurality of plasma elements connected in an array.

10. The method of claim 1, wherein the plasma element further comprises a plurality of selectively switchable plasma elements.

11. The method of claim 1, wherein the plasma includes at least one of argon, krypton, and xenon gas.

12. The method of claim 1, wherein the plasma is operated at a frequency of at least about two gigahertz.

13. The method of claim 1, wherein the plasma element further comprises a plurality of plasma elements that are shielded one from another.

14. The method of claim 1, wherein the plasma element further comprises a plurality of plasma elements that are pulsed sequentially and not simultaneously.

15. In a method of operating a plasma element of a plurality of selectively switchable plasma elements, the improvement comprising pulsing the plasma element at a pulse power for a pulse duration of between about two microseconds and about twenty microseconds and a pulse frequency of about one kilohertz to energize a plasma of a Ramsauer gas within the plasma element for an afterglow duration, where the pulse duration is shorter than the afterglow duration and the afterglow duration is no less than a reciprocal of the pulse frequency.

16. In a plasma element, the improvement comprising a pulser adapted to pulse the plasma element at a pulse power for a pulse duration and a pulse frequency to energize a plasma within the plasma element for an afterglow duration, where the pulse duration is shorter than the afterglow duration and the afterglow duration is no less than a reciprocal of the pulse frequency, wherein the plasma is of a Ramsauer gas.

17. The plasma antenna of claim 16, wherein the pulse duration is between about two microseconds and about twenty microseconds and the pulse frequency is about one kilohertz.

* * * * *